US008568079B2

(12) United States Patent
Walthers et al.

(10) Patent No.: US 8,568,079 B2
(45) Date of Patent: Oct. 29, 2013

(54) ROTATOR BRAKING SYSTEM FOR A LIFT TRUCK LOAD HANDLER

(75) Inventors: Christopher M. Walthers, Gresham, OR (US); Robert J. Flak, Gresham, OR (US)

(73) Assignee: Cascade Corporation, Portland, OR (US)

( * ) Notice: Subject to any disclaimer, the term of this patent is extended or adjusted under 35 U.S.C. 154(b) by 0 days.

(21) Appl. No.: 13/397,431

(22) Filed: Feb. 15, 2012

(65) Prior Publication Data

US 2013/0209206 A1 Aug. 15, 2013

(51) Int. Cl.
*B66F 9/18* (2006.01)

(52) U.S. Cl.
USPC ..... 414/620

(58) Field of Classification Search
USPC ..... 414/785, 620, 763, 632, 634, 635, 636; 192/215
See application file for complete search history.

(56) References Cited

U.S. PATENT DOCUMENTS

| | | | | |
|---|---|---|---|---|
| 2,595,131 | A * | 4/1952 | Ehmann | 414/620 |
| 2,752,055 | A * | 6/1956 | Hoppert | 414/620 |
| 2,754,018 | A | 7/1956 | Schroeder | |
| 2,807,382 | A * | 9/1957 | Schenkelberger | 414/620 |
| 2,815,878 | A * | 12/1957 | Vance | 414/620 |
| 2,932,419 | A * | 4/1960 | Harris | 414/620 |
| 2,984,985 | A | 5/1961 | MacMillin | |
| 3,147,872 | A * | 9/1964 | Olson | 414/620 |
| 3,179,274 | A | 4/1965 | Comfort | |
| 3,191,788 | A * | 6/1965 | Hopfeld | 414/420 |
| 3,955,480 | A * | 5/1976 | Wosegien | 92/130 R |
| 3,994,178 | A * | 11/1976 | Hore | 74/89.39 |
| 4,015,721 | A * | 4/1977 | Scheler | 414/744.3 |
| 4,161,256 | A | 7/1979 | Seaberg | |
| 4,177,000 | A * | 12/1979 | Weinert et al. | 414/620 |
| 4,516,905 | A * | 5/1985 | Cavin et al. | 414/620 |
| 4,681,505 | A | 7/1987 | Kobayashi et al. | |
| 4,742,468 | A | 5/1988 | Ohashi et al. | |
| 4,765,448 | A * | 8/1988 | Sommer | 192/18 A |
| 4,782,920 | A | 11/1988 | Gaibler et al. | |
| 5,228,822 | A * | 7/1993 | Schrader | 414/421 |

(Continued)

FOREIGN PATENT DOCUMENTS

| | | |
|---|---|---|
| EP | 1422187 B1 | 3/2011 |
| JP | 5-238685 | 9/1993 |
| JP | 5-238692 | 9/1993 |

OTHER PUBLICATIONS

Eaton Char-Lynn T-Brake Series Motor Catalog C-MOLO-MC001-E Sep. 2003, Specification Data—T-Brake Series, 1 page.

(Continued)

*Primary Examiner* — Saul Rodriguez
*Assistant Examiner* — Glenn Myers
(74) *Attorney, Agent, or Firm* — Chernoff, Vilhauer, McClung & Stenzel, LLP

(57) ABSTRACT

A hydraulic rotating and braking system for a lift truck-mountable load handling assembly has a hydraulically-driven worm screw with a hydraulic motor located adjacent one end of the screw and a friction brake located adjacent the opposite end of the screw. The system includes a friction brake having a brake controller located at least partially within the worm screw. The friction brake is releasable by the exhaust of fluid without the need for a fluid exhaust line extending to the lift truck's reservoir tank.

9 Claims, 3 Drawing Sheets

(56) References Cited

U.S. PATENT DOCUMENTS

| | | | | | |
|---|---|---|---|---|---|
| 5,281,076 | A | | 1/1994 | Lehman | |
| 5,536,133 | A | | 7/1996 | Velez et al. | |
| 5,605,071 | A | | 2/1997 | Buchanan, Jr. | |
| 5,685,141 | A | * | 11/1997 | Markstein et al. | 60/204 |
| 5,927,932 | A | | 7/1999 | Seaberg | |
| 6,318,949 | B1 | * | 11/2001 | Seaberg | 414/623 |
| 6,942,071 | B1 | | 9/2005 | Cannata et al. | |

OTHER PUBLICATIONS

International Searching Authority, Int'l Search Report and Written Opinion, PCT/US2013/022902, Mar. 22, 2013, 7 pages.

* cited by examiner

ROTATOR BRAKING SYSTEM FOR A LIFT TRUCK LOAD HANDLER

BACKGROUND OF THE INVENTION

This disclosure relates generally to improvements in lift truck-mounted, rotatable load handling equipment for picking up, transporting and stacking loads. Such rotatable load handling equipment is usually a load clamp, but this disclosure contemplates other types of rotatable load handling equipment as well such as forks, platens, etc. More particularly, the disclosure relates to improvements in rotator friction braking systems for such load handling equipment which enable a rotator to maintain an intended rotational attitude of a load handler when the rotator is not actuated, even though the load is imbalanced or subjected to dynamic influences.

The compactness of a rotator braking system is particularly important in lift truck mounted load handling equipment to prevent the bulk of the rotator braking system from requiring the center of gravity of the load to be positioned excessively forwardly of the lift truck's front axle. Any excessive forward projection of the load, and thus its center of gravity, can excessively limit the load weight which can be handled by a counterbalanced lift truck without adversely affecting its forward tipping stability about its front axle.

In the past, various types of hydraulic rotators have been used, with or without friction brakes, to rotate lift truck load handling equipment. Such a rotator powered by a hydraulic motor but without a friction brake is shown, for example, in U.S. Pat. No. 5,927,932.

Alternatively, for a number of years, Eaton Char-Lynn has offered a rotator hydraulic motor with one end of its drive shaft connected to a rotary friction brake, and the opposite end of its drive shaft adapted to be connected to a worm screw for driving a lift truck mounted rotator for a paper roll clamp. Although the Eaton friction brake assembly prevents unwanted drifting movement of the rotator when the rotator is not actuated, the friction brake assembly is very bulky with respect to its length and width dimensions, thereby limiting the load-carrying capacity of the counterbalanced lift truck upon which it is used as explained above. In addition, the large size of the Eaton brake assembly dictates low brake-actuating spring pressures and correspondingly low brake release hydraulic pressures, requiring a separate hydraulic exhaust conduit to be routed from the brake release assembly to the lift truck's hydraulic reservoir which occupies further space and creates conduit routing difficulties in the extremely confined space of the rotator assembly.

DETAILED DESCRIPTION OF PREFERRED EMBODIMENTS

Figure 2:
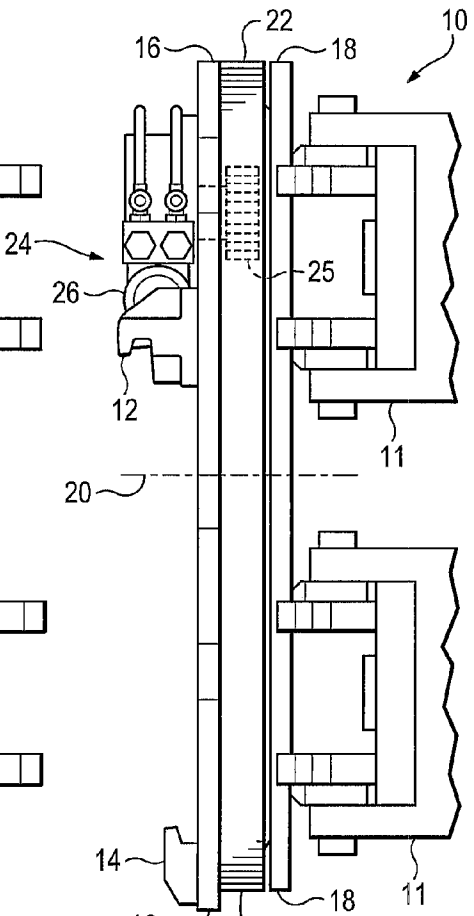
FIG. 2 is a partial side view of the load clamp of FIG. 1.
Figure 1:
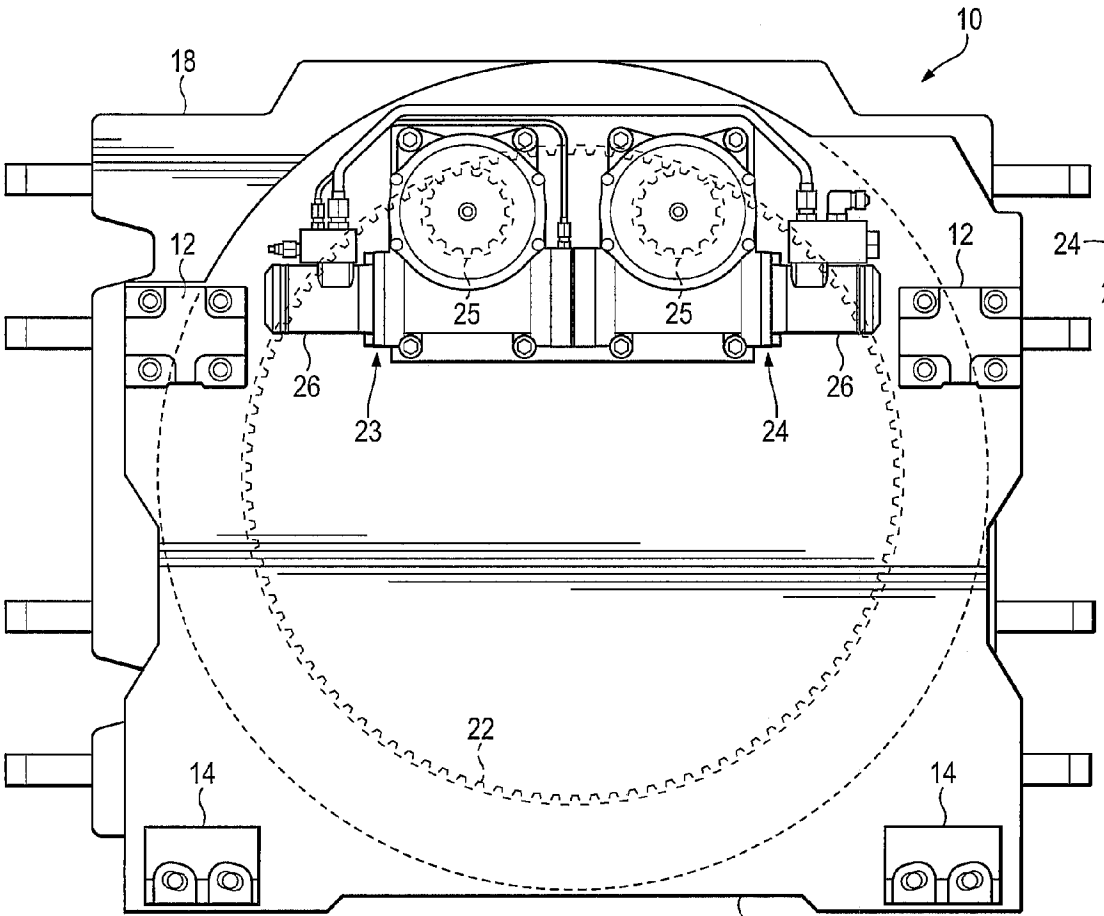
FIG. 1 is a rear view of a lift truck load clamp having an exemplary embodiment of a rotator braking system in accordance with the present disclosure.
Figure 3:
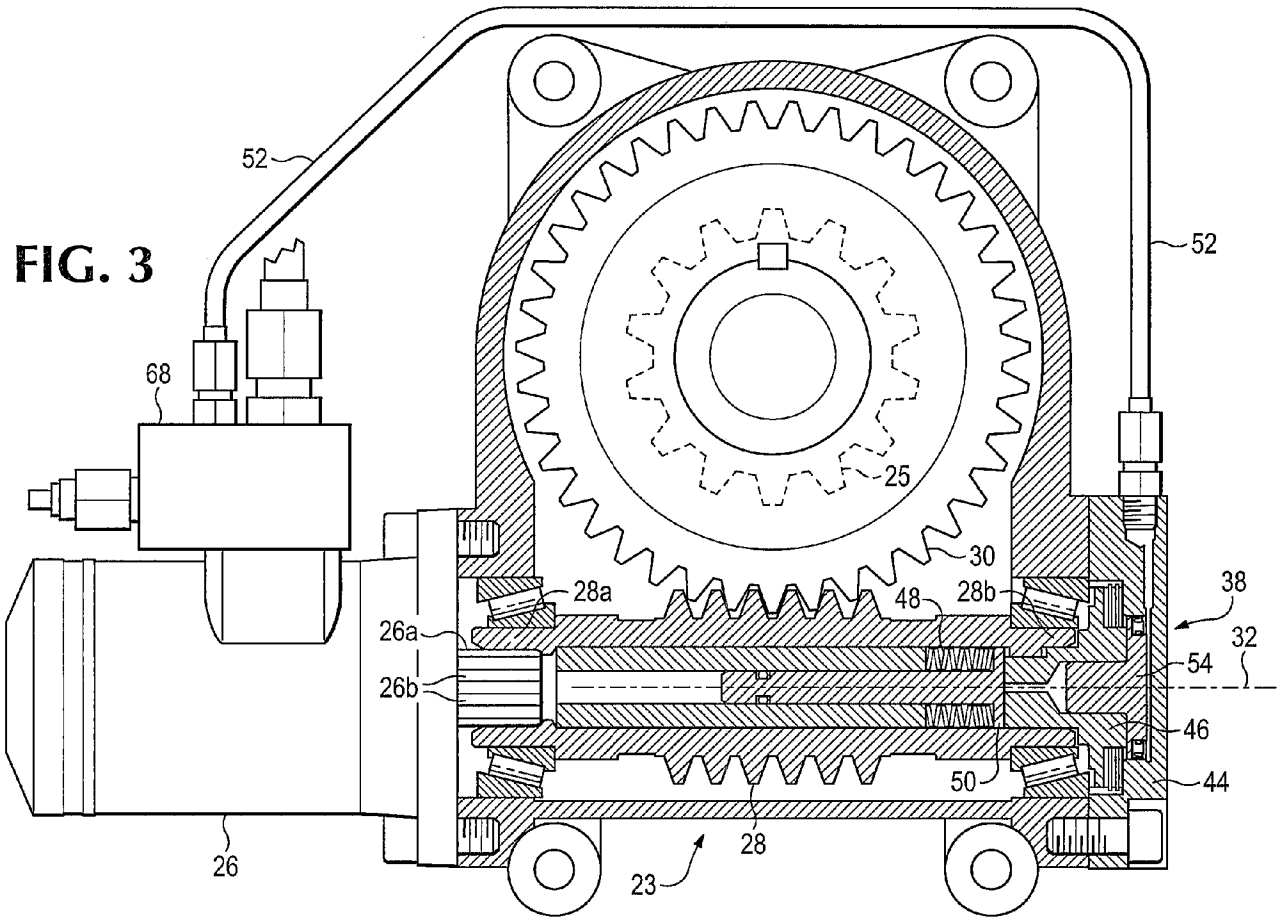
FIG. 3 is a partially sectional view of an exemplary rotator motor and braking system employed in the embodiment of FIG. 1.

Referring to FIGS. 1 and 2, an exemplary load handling assembly in the form of a paper roll clamp 10 having forwardly projecting clamp arms 11 is mountable to the load lifting carriage of a lift truck (not shown) by upper attaching hooks 12 and lower attaching hooks 14. The hooks 12 and 14 are connected to the rear side of a base 16 upon which a frame 18 is rotatably mounted so as to rotate around a forwardly extending axis of rotation 20. The frame 18 includes a large circular ring gear 22 which can be driven selectively bi-directionally by one or more rotator drive units such as 23, 24. Each rotator drive unit 23, 24 has a respective pinion gear 25, for rotating the ring gear 22 around the axis 20, driven by a respective bi-directional hydraulic motor 26 through a shaft 26*a* and respective worm screw 28 and worm gear 30 as shown in FIG. 3 with respect to drive unit 23. The rotation of the frame 18 can be continuous in either direction. As shown in FIG. 3, the hydraulic motor 26 is adjacent to the end 28*a* of the worm screw 28, preferably connected by splines 26*b* to the end 28*a* so as to drive the worm screw selectively in either direction about a worm screw axis of rotation 32.

As described so far, the left hand rotator drive unit 23 and the right hand rotator drive unit 24 shown in FIG. 1 are substantially similar. However, there is a major difference between the two drive units 23 and 24, in that the drive unit 23 not only has a rotator driving function but also a friction braking function, whereas the drive unit 24 has only a rotator driving function. If only a single rotator drive unit were to be employed on the load handling assembly 10, it would be the drive unit 23 because of its additional braking function to be described hereafter. If one or more additional drive units, such as the drive unit 24, were to be employed, such additional unit(s) would normally not have a braking function unless the expected braking force needed were greater than could be provided by the friction brake of the drive unit 23, in which case one or more additional drive units such as 23 with a brake function could be added as necessary. Regardless of the type and number of any additional drive units needed for any particular application, they can be distributed in convenient locations around the interior of the ring gear 22 without requiring the load handling assembly or the center of gravity of the load to be any further forward from the front axle of the lift truck than if only a single drive unit 23 were employed, thereby substantially preserving the load carrying capacity of a counterbalanced lift truck without substantially decreasing the lift truck's forward stability about its front axle.

An example of the exceptionally compact type of friction brake assembly preferred herein will now be described with respect to the drive unit 23, with reference to FIGS. 3 and 4. Adjacent to the end 28*b* of the worm screw 28, opposite to the end 28*a* where the hydraulic drive motor 26 is drivingly connected to the worm screw 28, an exemplary friction brake assembly generally indicated as 38 is located to selectively prevent the worm screw's rotation about its axis of rotation 32. The exemplary friction brake assembly 38 shown in FIG. 3 preferably comprises a number of friction discs 40, best shown in FIG. 4, having friction-inducing surfaces on both sides and separated by respective pressure plates 42 with peripheral splines 43 slidably keyed into respective grooves 45 in an end cover 44 to prevent rotation of the pressure plates 42. The friction discs 40, on the other hand, are prevented from rotation about the worm screw axis 32 only when the brake assembly is actuated, and selectively permitted to rotate about the axis 32 when the brake assembly is released.

Figure 4:
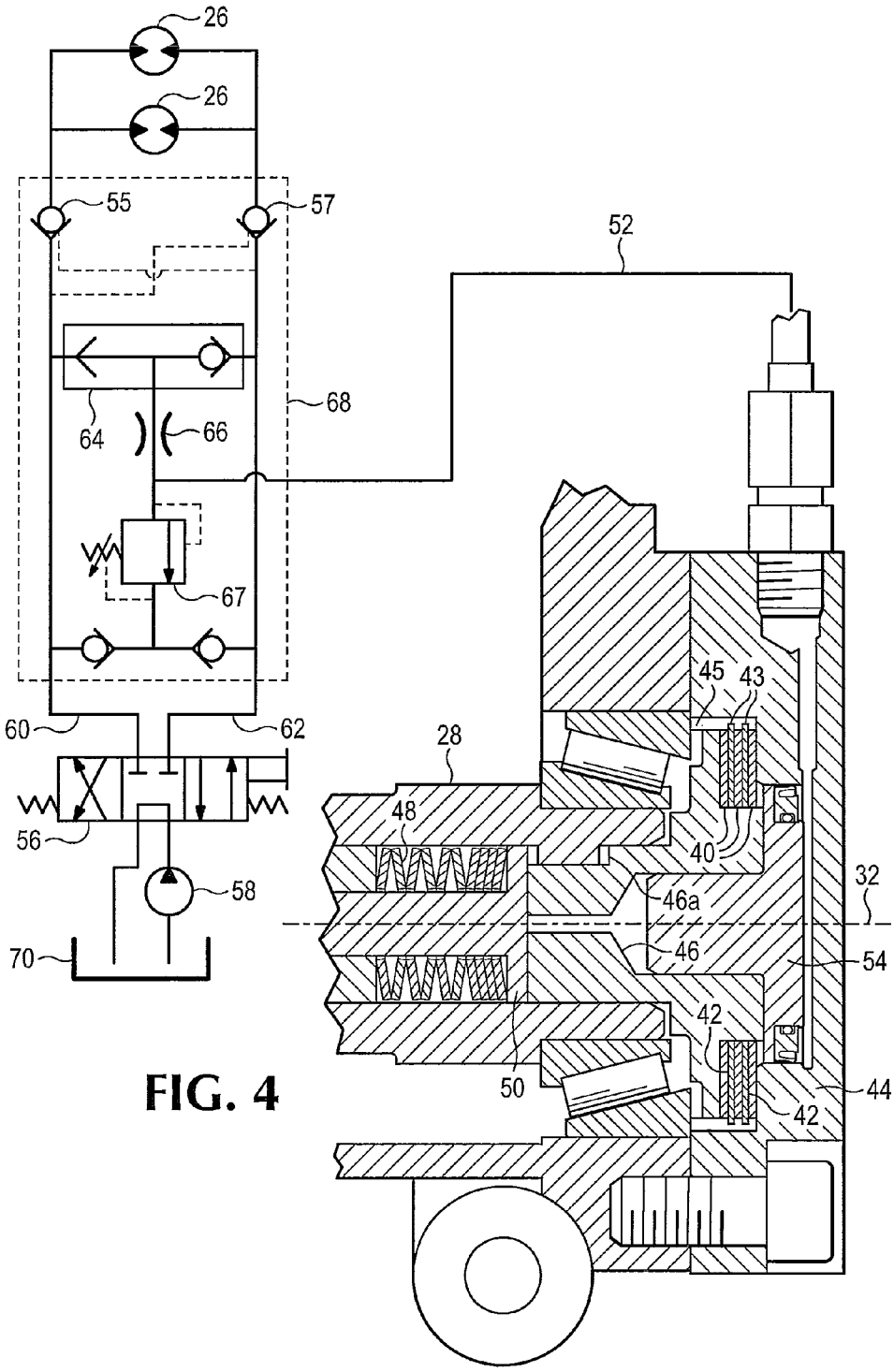
FIG. 4 is a partially schematic diagram of the hydraulic valve circuitry employed in the rotator motor and braking system of FIG. 3, showing an enlarged sectional view of the brake assembly in its actuated condition.

With reference to FIG. 4, actuation and release of the brake assembly is accomplished by a brake controller having an actuator mechanism and a release mechanism. With respect to the actuator mechanism, actuation of the brake occurs if an actuator spring 48, which can for example be constructed of Bellville type washers or other suitable spring types, is permitted to exert brake actuating force through a rod-guided pressure plate 50 against a brake rotor 46, thereby clamping the friction discs 40 and pressure plates 42 tightly against the end cover 44 and thereby preventing rotation of the rotor 46. Conversely, with respect to the release mechanism, hydraulic pressure applied through a brake release conduit 52 against a brake release piston 54 forces the brake rotor 46 to move to the left in FIG. 4 to oppose the force of the actuator spring 48, thereby loosening the clamping force between the brake rotor 46 and the end cover 44 to allow the brake rotor 46 to rotate freely. Because the brake rotor 46 is slidably connected by longitudinal splines, such as 46*a* in FIG. 4, to the interior of the worm screw 28, the worm screw is thus selectively released or braked depending upon whether the brake rotor 46 is free to rotate (brake released) or not (brake actuated).

When the friction brake assembly is released, the worm screw 28 and the worm gear 30 are free to be rotated by the motor 26 so that the drive unit 23, as well as any other drive unit such as 24, can cause rotation of the ring gear 22 and its frame 18 with respect to the base 16. Conversely, when the brake assembly is actuated, rotation of the frame 18 and its ring gear 22 with respect to the base is prevented because the worm screw 28 and worm gear 30 are prevented from turning by the brake assembly.

The exemplary embodiment of FIGS. 3 and 4 shows that brake actuator components of the brake controller, i.e. the rod-guided-pressure plate 50 and actuator spring 48, are located within the worm screw 28. However, it would be possible to reverse the brake controller if desired so that brake release components of the brake controller, such as the piston 54, are located at least partially within the worm screw 28. This could be accomplished, for example, by making the piston 54 smaller and compensating by increasing the brake release hydraulic pressure in conduit 52, and/or by designing the worm screw to have a larger diameter to accept the piston 54. As a further alternative, both the actuator components and release components of the brake controller could be at least partially within the worm screw.

An exemplary hydraulic diagram for the drive and brake control aspects of the embodiment of FIGS. 1-3 is shown in FIG. 4. The brake assembly is automatically actuated by the brake spring 48 when there is insufficient brake release pressure present in conduit 52 which feeds the brake release piston 54. This condition exists whenever the operator's manual rotation direction control valve 56 is centered as shown in FIG. 4 so that no pressurized fluid from the lift truck's pump 58 is being supplied to either of the opposite directional fluid lines 60 or 62 normally used to drive the motors 26. When the operator moves the valve 56 from its centered position in one direction or the other to open the pilot-operated check valves 55 and 57 and thereby drive the motors 26 to cause rotation of the frame 18 in a selected direction, a small amount of the high-pressure fluid in the selected pressurized line 60 or 62 will be directed through a shuttle valve 64 and orifice 66 of a brake-control valve assembly 68 through the conduit 52 and thereby to the piston 54 to automatically release the brake in the manner described previously, while the major quantity of the high-pressure fluid concurrently commences rotation of the frame 18 by the motors 26. A relief valve 67 limits the pressure in the conduit 52 to a predetermined pressure appropriate to release the brake.

Conversely, when the operator later returns the valve 56 to its centered position to disable the motors 26 from causing rotation of the frame 18, the valve assembly 68 automatically causes actuation of the brake by exhausting fluid from the piston 54 of the brake assembly through conduit 52, orifice 66 and shuttle valve 64 into at least one of the lines 60 or 62 (as the position of the shuttle valve permits) since the pressure in both lines 60 and 62 will be low and approximately equal at that time due to the centered position of the operator's valve 56. This arrangement eliminates any need for the exhaust conduit 52 to bypass the valve assembly 68 and operator's valve 56 and extend all the way to the lift truck's hydraulic fluid reservoir tank 70 in order to find an adequate low-pressure receptacle for the fluid exhausted from the brake assembly. This advantage is also aided by the small compact size of the brake assembly, which produces a minimum of fluid volume to be exhausted through conduit 52 when the brake is actuated so that the exhausted fluid can merely be stored in line 60 or 62 without excessive back pressure hindering actuation of the brake.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A load-handling assembly mountable upon a lifting apparatus to engage and rotate a load, said load-handling assembly comprising:

(a) a base adapted to be mounted on said lifting apparatus;

(b) a frame mounted rotatably on said base;

(c) a motor adapted to rotate said frame with respect to said base;

(d) a worm screw adapted to be rotatably driven about an axis of rotation by said motor to rotate said frame, said worm screw having a first end and a second end spaced apart along said axis of rotation;

(e) said motor being located adjacent to said first end of said worm screw; and (f) a friction brake assembly located adjacent to said second end of said worm screw adapted to selectively prevent rotation of said frame.

2. The assembly of claim 1, including a further motor adapted to rotate said frame with respect to said base and a further worm screw adapted to be rotatably driven by said further motor to rotate said frame, without any further said friction brake assembly.

3. A load-handling assembly mountable upon a lifting apparatus to engage and rotate a load, said load-handling assembly comprising:

(a) a base adapted to be mounted on said lifting apparatus;

(b) a frame mounted rotatably on said base;

(c) a motor adapted to rotate said frame with respect to said base;

(d) a worm screw adapted to be rotatably driven by said motor to enable said motor to cause said rotation of said frame;

(e) a friction brake assembly including a brake controller having a release mechanism, adapted to cause said brake assembly to selectively permit said rotation of said frame with respect to said base, and an actuator mechanism, adapted to cause said brake assembly to selectively prevent said rotation of said frame with respect to said base;

(f) said brake controller being located at least partially within said worm screw.

4. The assembly of claim 3, wherein said actuator mechanism is located at least partially within said worm screw.

5. The assembly of claim 3, including a further motor adapted to rotate said frame with respect to said base and a further worm screw adapted to be rotatably driven by said further motor to rotate said frame, without any further said friction brake assembly.

6. A load-handling assembly mountable upon a lifting apparatus to engage and rotate a load, said load-handling assembly comprising:

(a) a base adapted to be mounted on said lifting apparatus;

(b) a frame mounted rotatably on said base;

(c) a fluid power motor adapted to rotate said frame with respect to said base in either of two opposite direction, said fluid power motor being controlled by a rotation direction control valve through a pair of fluid power lines each capable of alternately conducting fluid to or exhausting fluid from said fluid power motor so as to alternatively enable or not enable said motor to cause rotation of said frame with respect to said base;

(d) a fluid power-releasable friction brake assembly adapted to selectively permit or prevent said rotation of said frame with respect to said base, said friction brake assembly and said pair of fluid power lines being operably connected to a fluid power brake-control valve assembly interposed hydraulically between said rotation direction control valve and said fluid power motor so that, when said pair of fluid power lines do not enable said motor to cause said rotation of said frame, said brake-control valve assembly causes actuation of said friction brake assembly by automatically exhausting fluid from said friction brake assembly through said brake-control valve assembly into at least one of said pair of fluid power lines.

7. The assembly of claim 6, including a further fluid power motor adapted to rotate said frame with respect to said base selectively in either of said two opposite directions, said further fluid power motor being operably connected to said pair of fluid power lines and to said brake-control valve assembly.

8. A load-handling assembly mountable upon a lifting apparatus to engage and rotate a load, said load-handling assembly comprising:

(a) a base adapted to be mounted on said lifting apparatus;

(b) a frame mounted rotatably on said base;

(c) a motor adapted to rotate said frame with respect to said base;

(d) a worm screw adapted to be rotatably driven about an axis of rotation by said motor to rotate said frame, said worm screw having a first end and a second end spaced apart along said axis of rotation;

(e) said motor being located adjacent to said first end of said worm screw; and (f) a friction brake assembly located adjacent to said second end of said worm screw adapted to selectively prevent said worm screw's rotation about said axis of rotation while substantially preventing axial movement of said worm screw relative to said base.

9. The assembly of claim 8, including a further motor adapted to rotate said frame with respect to said base and a further worm screw adapted to be rotatably driven by said further motor to rotate said frame, without any further said friction brake assembly.

* * * * *